US011145450B2

(12) United States Patent
Sakai

(10) Patent No.: US 11,145,450 B2
(45) Date of Patent: Oct. 12, 2021

(54) MAGNETIC ELEMENT

(71) Applicant: NTN CORPORATION, Osaka (JP)

(72) Inventor: Kayo Sakai, Mie (JP)

(73) Assignee: NTN CORPORATION, Osaka (JP)

( * ) Notice: Subject to any disclaimer, the term of this patent is extended or adjusted under 35 U.S.C. 154(b) by 347 days.

(21) Appl. No.: 15/761,105

(22) PCT Filed: Sep. 16, 2016

(86) PCT No.: PCT/JP2016/077412
§ 371 (c)(1),
(2) Date: Mar. 18, 2018

(87) PCT Pub. No.: WO2017/047740
PCT Pub. Date: Mar. 23, 2017

(65) Prior Publication Data

US 2018/0294087 A1 Oct. 11, 2018

(30) Foreign Application Priority Data

Sep. 17, 2015 (JP) ..... 2015-184384
Apr. 25, 2016 (JP) ..... JP2016-087024

(51) Int. Cl.
*H01F 27/24* (2006.01)
*H01F 3/08* (2006.01)
(Continued)

(52) U.S. Cl.
CPC ..... *H01F 27/24* (2013.01); *H01F 3/08* (2013.01); *H01F 3/10* (2013.01); *H01F 17/043* (2013.01);
(Continued)

(58) Field of Classification Search
CPC ... H01F 27/24; H01F 3/08; H01F 3/10; H01F 27/306; H01F 17/045; H01F 17/043;
(Continued)

(56) References Cited

U.S. PATENT DOCUMENTS 2,220,126 A * 11/1940 Holst ..... H01F 17/043 336/83
4,047,138 A * 9/1977 Steigerwald ..... H01F 27/255 336/100
(Continued)

FOREIGN PATENT DOCUMENTS

CN 103733283 A 4/2014
CN 203839157 U 9/2014
(Continued)

OTHER PUBLICATIONS

International Search Report for PCT/JP2016/077412 dated Dec. 20, 2016.
(Continued)

*Primary Examiner* — Tuyen T Nguyen
(74) *Attorney, Agent, or Firm* — Hedman & Costigan, P.C.; James V. Costigan; Kathleen A. Costigan

(57) ABSTRACT

To provide a magnetic element capable of reducing working man hour, the number of components, and an amount of a copper wire. A magnetic element 1 is provided with a coil assembly 4 including a core 2 formed by a compression molded magnetic body and a coil 3 wound on an outer periphery of the core 2, and an outer peripheral core 5 that surrounds an outer periphery of the coil assembly 4. The outer peripheral core 5 is formed by an injection molded magnetic body and includes an opening 5*a* into which the coil can be inserted, and a pair of grooves 5*b* into which both end portions in an axial direction of the core 2, the groove 5*b* being provided as a fixing unit for fixing the coil assembly 4 in the outer peripheral core and formed on an inner peripheral surface of the outer peripheral core.

3 Claims, 18 Drawing Sheets

(51) Int. Cl.

| | |
|---|---|
| ***H01F 3/10*** | (2006.01) |
| ***H01F 27/30*** | (2006.01) |
| ***H01F 17/04*** | (2006.01) |
| ***H01F 27/02*** | (2006.01) |
| ***H01F 27/28*** | (2006.01) |
| ***H01F 41/02*** | (2006.01) |

(52) U.S. Cl.
CPC ..... *H01F 17/045* (2013.01); *H01F 27/02* (2013.01); *H01F 27/2823* (2013.01); *H01F 27/306* (2013.01); *H01F 41/0246* (2013.01); *H01F 2003/106* (2013.01)

(58) Field of Classification Search
CPC .. H01F 27/02; H01F 27/2823; H01F 41/0246; H01F 2003/106
See application file for complete search history.

(56) References Cited

U.S. PATENT DOCUMENTS

| | | | | |
|---|---|---|---|---|
| 4,314,221 | A * | 2/1982 | Satou | H01F 27/29 336/192 |
| 5,347,255 | A | 9/1994 | Saitoh | |
| 6,348,850 | B1 * | 2/2002 | Kimura | H01F 17/045 336/200 |
| 7,911,308 | B2 * | 3/2011 | Rippel | H01F 27/025 336/182 |
| 2007/0285200 | A1 * | 12/2007 | Hsieh | H01F 27/292 336/83 |
| 2010/0253202 | A1 | 10/2010 | Levers, Jr. | |
| 2010/0259351 | A1 * | 10/2010 | Bogert | H01F 5/003 336/200 |
| 2011/0309905 | A1 * | 12/2011 | Anger | H01F 3/14 336/212 |
| 2013/0249666 | A1 * | 9/2013 | Suzuki | H01F 27/263 336/210 |
| 2014/0160819 | A1 * | 6/2014 | Inaba | H01F 27/24 363/123 |
| 2014/0176291 | A1 | 6/2014 | Zheng | |
| 2015/0179323 | A1 | 6/2015 | Uemoto | |

FOREIGN PATENT DOCUMENTS

| | | | | |
|---|---|---|---|---|
| CN | 104488042 | A | 4/2015 | |
| DE | 112012003217 | T5 | 7/2014 | |
| EP | 1265460 | A * | 12/2002 | H01F 27/255 |
| EP | 2879139 | A1 | 6/2015 | |
| GB | 1166835 | A * | 10/1969 | H01F 38/10 |
| JP | 09-289119 | A | 11/1997 | |
| JP | 11-329859 | A | 11/1999 | |
| JP | 2000-331841 | A | 11/2000 | |
| JP | 2000-340427 | A | 12/2000 | |
| JP | 3255621 | B2 | 2/2002 | |
| JP | 2006-032559 | A | 2/2006 | |
| JP | 2009-141117 | A | 6/2009 | |
| JP | 4763609 | B2 | 8/2011 | |
| JP | 2013-051402 | A | 3/2013 | |
| JP | 2014-027050 | A | 2/2014 | |
| JP | 2014-232755 | A | 12/2014 | |
| KR | 10-2015-0038234 | A | 4/2015 | |
| WO | 2013/018381 | A1 | 2/2013 | |
| WO | 2014/017512 | A1 | 1/2014 | |

OTHER PUBLICATIONS

English Claims for JP 4763609 B2 dated Aug. 31, 2011.
English Abstract for JP 2000-331841 A dated Nov. 30, 2000.
English Abstract for JP 2006-032559 A dated Feb. 2, 2006.
English Abstract for JP 2013-051402 A dated Mar. 14, 2013.
English Abstract for WO 2013/018381 A1 dated Feb. 7, 2013.
English Abstract for DE 112012003217 T5 dated Jul. 3, 2014.
English Abstract for CN 103733283 A dated Apr. 16, 2014.
English Claims for JP 3255621 B2 dated Feb. 12, 2002.
English Abstract for JP 2009-141117 A dated Jun. 25, 2009.
English Abstract for JP 09-289119 A dated Nov. 4, 1997.
English Abstract for JP 11-329859 A dated Nov. 30, 1999.
English Abstract for JP 2014-027050 A dated Feb. 6, 2014.
English Abstract for CN 104488042 A dated Apr. 1, 2015.
English Abstract for KR 10-2015-0038234 A dated Apr. 8, 2015.
Supplementary European Search Report dated May 9, 2019.
English Machine Translation for JP 2000-340427 A dated Dec. 8, 2000.
English Machine Translation for JP 2014-232755 A dated Dec. 11, 2014.
English Abstract for CN 203839157 U dated Sep. 17, 2014.

* cited by examiner (a)

(b)

MAGNETIC ELEMENT

TECHNICAL FIELD

The present invention relates to a magnetic element in which a coil assembly is arranged around a magnetic body, the magnetic element being used as an inductor, a transformer, an antenna (a bar antenna), a choke coil, a filter or a sensor in an electric device or an electronic device. In particular, the present invention relates to a magnetic element mounted on a substrate.

BACKGROUND ART

In recent years, along with the progress of increase of frequency and increase of electric current of an electric device and an electronic device, a magnetic element is required to be dealt with similarly. In the current mainstream ferrite materials as a magnetic body, the material properties themselves are approaching the limit, and thus a new magnetic body material is being required. For example, the ferrite materials are replaced with compression molded magnetic materials such as Sendust and amorphous metal, or amorphous foil strip. However, the molding performance of the compression molded magnetic material described above is inferior, and the mechanical strength after baking is low. Further, the production cost of the amorphous foil strip is high due to winding, cutting and formation of gaps. Therefore, the practical application of these magnetic materials is delayed.

In Patent Document 1, it is proposed to provide a method for producing small-sized and inexpensive magnetic core parts having various shapes and characteristics by using a magnetic powder having poor molding performance. Patent Document 1 proposes a method for producing a core part having predetermined magnetic characteristics by injection molding, the method including coating a magnetic powder contained in a resin composition used in the injection molding with an insulation material, and insert-molding either of a compression molded magnetic body and a pressurized powder magnet-molded body in the resin composition, wherein the compression molded magnetic body or the pressurized powder magnet-molded body contains a binder having a melting point lower than the injection molding temperature (see Patent Document 1).

As a magnetic element capable of reducing the number of components and producing man hour, reducing a height of a product, and improving reliability, a magnetic element in which a part of a magnetic path of a magnetic core structural body is formed by an insulating base of a composite magnetic molded body and a terminal of a coil is drawn directly toward the base as an external terminal, is known (see Patent Document 2).

FIGS. 17 (*a*) and 17(*b*) show a conventional EEP type magnetic element. FIG. 17(*a*) is a perspective view illustrating an assembling method thereof, and FIG. 17(*b*) is a perspective view illustrating a completed product. A magnetic element 41 is assembled by inserting cores 42*a* into a coil 43 in a state in which the cores 42*a* of two members face to each other, each of the members being formed by the core 42*a* and an outer peripheral core 42 formed integrally. When assembling, it is necessary to position the two members in a radial direction and an axial direction. Especially, in a case of performing resin sealing, it is necessary to perform the positioning precisely, and therefore working man hour is increased. Further, it is necessary to perform the resin sealing in a state in which the coil 43 is embedded, and therefore filling of a sealing resin takes much time, and a void is apt to be generated.

In a hybrid magnetic element combining the outer peripheral core 42 and the core 42*a* formed by different materials is formed, two coil outer peripheral cores and one of more coil inner diameter side cores are combined, and therefore the number of components is increased. As described above, the conventional EEP type magnetic element is desired to be improved in manufacturing and in quality.

PRIOR ART DOCUMENTS

Patent Documents

Patent Document 1: JP 4763609 B
Patent Document 2: JP 2000-331841 A

SUMMARY OF THE INVENTION

Problems to be Solved by the Invention

Contrary to a drum type core having an opened magnetic path, in a magnetic element having a closed magnetic path such as a pot type core, an EER type core, an EEP type core, and a core in which a drum type core and an outer peripheral core are combined, magnetic flux leakage is less because an air gap in the magnetic path is small, and therefore a body of the magnetic element having the closed magnetic path can be made small compared to the magnetic element having the opened magnetic path. However, in the pot type core, the EER type core, or the EEP type core, when assembling the magnetic element or filling resin into a gap between the coil and the outer peripheral core, it is necessary to position a core of the coil assembly in which the coil is arranged in the radial direction and the axial direction of the coil, and therefore working man hour is increased. Further, in the core in which the drum type core, the coil, and the outer peripheral core are combined, a bending radius of the coil becomes larger as a section of a magnetic wire is large, and therefore a degree of freedom of arranging of a coil terminal is deteriorated because the coil terminal is protruded largely toward a core outer periphery. Consequently, a body of the magnetic element becomes large.

An object of the present invention is, in order to solve such a problem, to provide a magnetic element capable of reducing workingman hour, and reducing the number of components and an amount of metal having excellent conductivity such as a copper wire.

Means for Solving the Problem

A magnetic element of the present invention is provided with a coil assembly including a core and a coil arranged at an outer periphery of the core, and an outer peripheral core that surrounds an outer periphery of the coil assembly. The outer peripheral core includes an opening into which the coil assembly is inserted, and a fixing unit configured to fix the coil assembly in the outer peripheral core. Especially, the core may be formed by a compression molded magnetic body, and the outer peripheral core may be formed by an injection molded magnetic body.

In a case in which the magnetic element includes the core formed as a columnar core with a pair of flanges at both ends in an axial direction of the columnar core, the fixing unit may be formed by an outer peripheral shape of a pair of the flanges formed to adhere to an inner peripheral surface of the outer peripheral core so that the coil assembly is fixed to the outer peripheral core.

In a case in which the magnetic element includes the core formed as a columnar core, the fixing unit may be formed by at least one of (1) a pair of grooves arranged on an inner peripheral surface in the outer peripheral core and into which both end portions in an axial direction of the columnar core is inserted, and (2) at least one through hole into which the core is inserted, the through hole being arranged in the outer peripheral core, so that the coil assembly is fixed to the outer peripheral core.

In a case in which the magnetic element includes the core formed as a columnar core, a spacer formed to be fitted with the columnar core may be arranged in at least one of an intermediate portion in an axial direction, an end surface portion in the axial direction, a circumferential portion adjacent to an end surface in the axial direction of the columnar core.

Further, the outer peripheral core in which the coil assembly is fixed may be formed such that at least one outer peripheral surface of the outer peripheral core is fixed to a substrate of an electronic device.

Effect of the Invention

The magnetic element of the present invention includes the opening into which the coil assembly can be inserted and the fixing unit that fixes the coil assembly in the outer peripheral core, and thereby workability in fixing the coil assembly in the outer peripheral core is improved. Further, in a case of a hybrid magnetic core in which the core is formed by a compression molded magnetic body having excellent heat conductivity and the outer peripheral core is formed by an injection molded magnetic body, the core and the outer peripheral core are separated and therefore the outer peripheral core is not divided into two parts, and thereby the number of components can be reduced. Further, the spacer that can be fitted with the core is arranged, and thereby adhering of the spacer is not necessary when the coil assembly is formed by assembling the coil and the core, and therefore the workability in assembling is improved. Since the spacer can be visually checked after the coil and the core are assembled, erroneous assembling can be avoided. Further, when the magnetic element is fixed to the substrate of the electronic device, the optimum arrangement in which the opening faces the substrate or the like can be adopted easily, and thereby an amount of a magnet wire used in the coil and a processing cost can be reduced.

MODE FOR CARRYING OUT THE INVENTION

In the increase of frequency and the increase of electric current of an electric device and an electronic device, the magnetic element using the current mainstream ferrite material obtained by a compression molding method has excellent magnetic permeability and an inductance value can be obtained easily, however frequency characteristics and current superimposition characteristics are inferior. On the other hand, the magnetic element using the injection molded magnetic material including amorphous material has excellent frequency characteristics and current superimposition characteristics, however the magnetic permeability thereof is inferior. Further, in the magnetic element for large current, heat generation due to iron loss cannot be ignored in addition to heat generation due to copper loss. In the present invention, it is preferable to adopt a hybrid magnetic element in which a magnetic body, which becomes a core where heat is easily generated or heat is hardly dissipated, is formed by a compression molded magnetic body having excellent heat conductivity, and a magnetic body, which becomes an outer peripheral core, is formed by an injection molded magnetic body. By adopting a structure of the present invention, the number of components can be reduced, and workability in assembling can be improved.

Figure 1:
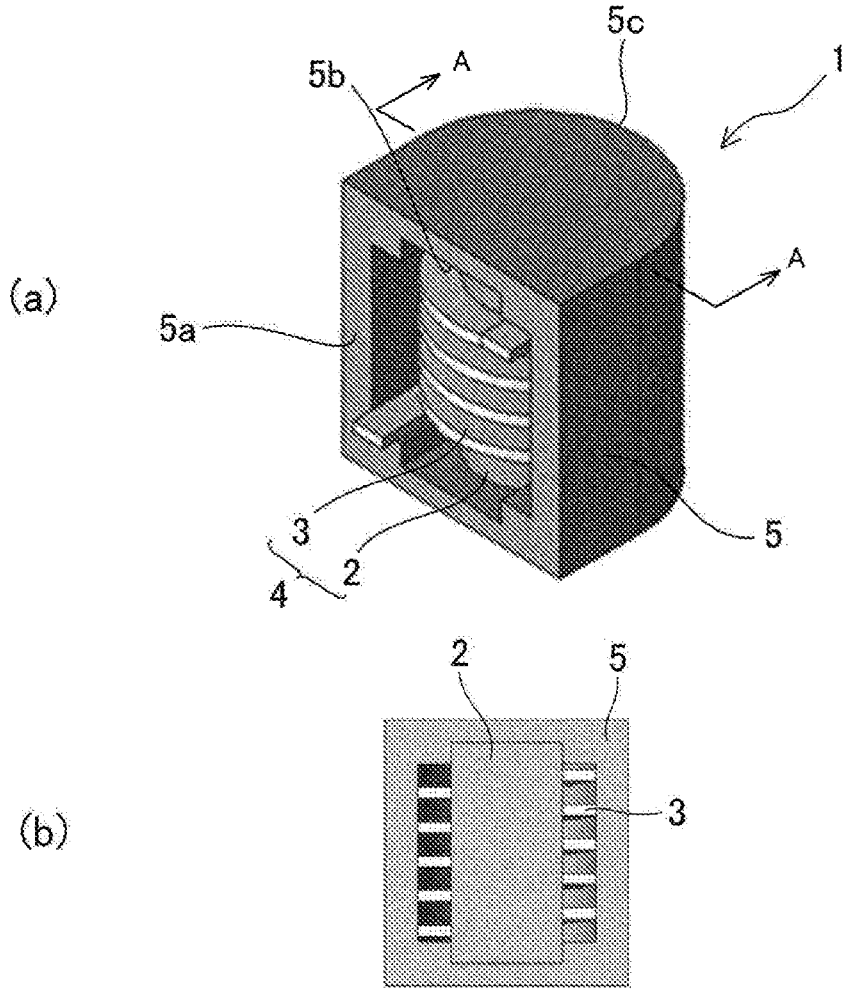
FIGS. 1(*a*) and 1(*b*) are perspective views illustrating an EEP type magnetic element.

FIGS. 1(*a*) and 1 (*b*) show one example of a magnetic element of the present invention. FIG. 1(*a*) is a perspective view of an EEP type magnetic element, and FIG. 1 (*b*) is a cross-sectional view taken along line A-A. A magnetic element 1 is provided with a coil assembly 4 including a core 2 having a cylindrical shape and a coil 3 arranged at an outer periphery of the core 2, and an outer peripheral core 5 that surrounds an outer periphery of the coil assembly 4. A groove 5*b* is arranged on the outer peripheral core 5 at a side of an opening 5*a*, and a back surface 5*c* of the outer peripheral core 5 at an opposite side is formed in a half circular shape in a plane view. The core 2 having a cylindrical shape is inserted to be orthogonal to an axis of the magnetic element 1. The core 2 and the outer peripheral core 5 are magnetically integrated.

Figure 2:
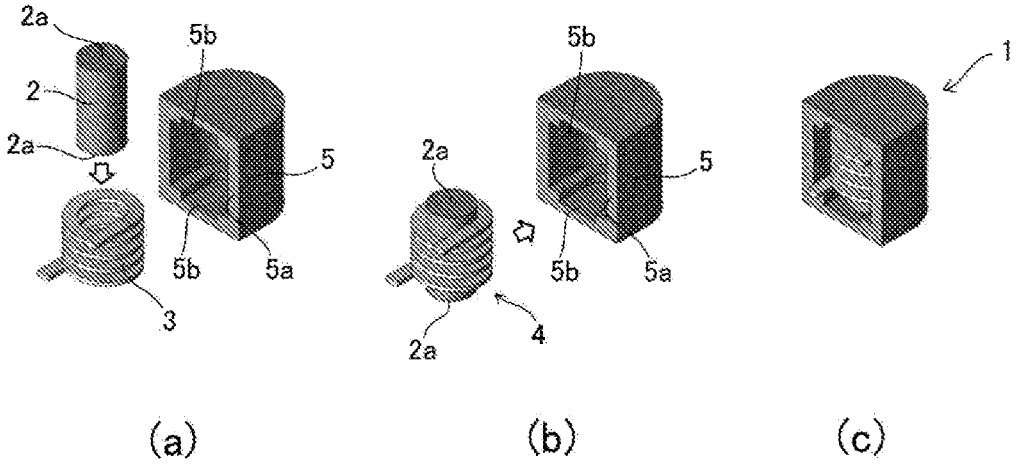
FIGS. 2(*a*) to 2(*c*) are views illustrating an assembling flow of the EEP type magnetic element shown in FIGS. 1(*a*) and 1 (*b*).

FIGS. 2(*a*) to 2(*c*) show an assembling method of the magnetic element 1. FIGS. 2(*a*) to 2(*c*) show perspective views of an assembling flow. A magnetic member that forms the magnetic element 1 is formed by two components separated into the core 2 and the outer peripheral core 5. The outer peripheral core 5 has the opening 5*a* into which the coil assembly 4 can be inserted, and the grooves 5*b* for fixing the coil assembly 4 in the outer peripheral core 5, at an upper side and a lower side of the opening. The core 2 having a cylindrical shape is inserted into the coil 3 wound in advance, along a direction of an arrow (FIG. 2(*a*)). The core 2 having a cylindrical shape is inserted along the direction of an arrow such that both end portions 2*a* of the core 2 are along the upper and lower grooves 5*b* formed on an inner peripheral surface of the outer peripheral core 5. The groove 5*b* positions the core 2 having a cylindrical shape in an axial direction and in a radial direction excluding one direction of insertion (FIG. 2(*b*)). That is, the assembly 4 is fixed in the outer peripheral core 5 when inserted into the outer peripheral core 5 along the grooves 5*b* (FIG. 2(*c*)). In this way, in the present invention, since the core 2 having a cylindrical shape is inserted in a direction orthogonal to the axial direction of the coil, it is not necessary to perform positioning with respect to the radial direction other than the insertion direction, and the axial direction, and therefore the assembling is facilitated. Further, since the outer peripheral core 5 and the core 2 having a cylindrical shape are combined, the number of components can be reduced. Further, the core 2 may be formed in a polygonal columnar shape other than a cylindrical shape as long as the core 2 is formed in a columnar shape.

Figure 17:
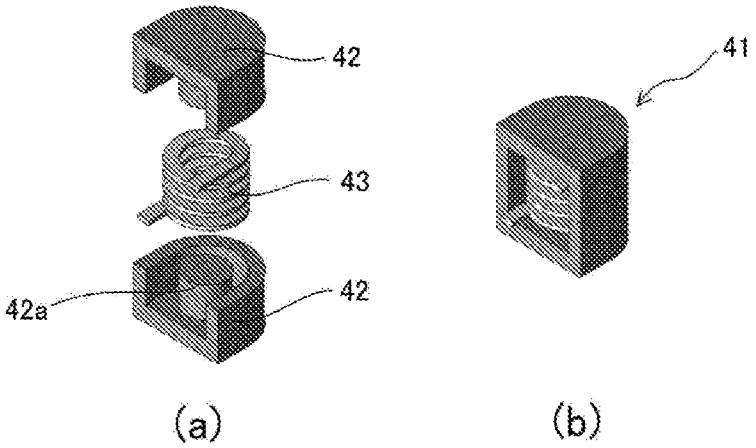
FIGS. 17(*a*) and 17(*b*) are views illustrating a conventional EEP type magnetic element.

In a case in which resin sealing is performed, it is necessary to position the conventional EEP type core shown in FIGS. 17(*a*) and 17(*b*) in the radial direction and the axial direction precisely. On the other hand, in the present invention, it is not necessary to perform the positioning of the magnetic element in the radial direction and the axial direction, and therefore workability in assembling can be improved. Further, by arranging a sealing resin in advance, filling time of the sealing resin can be reduced and generation of a void can be suppressed, and therefore reliable magnetic element can be obtained.

Figure 3:
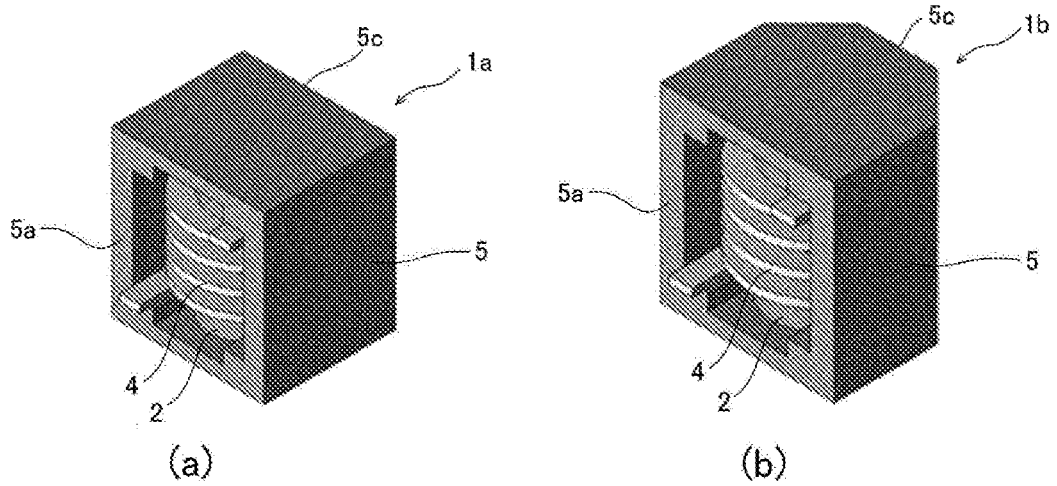
FIGS. 3(*a*) and 3(*b*) are perspective views illustrating other examples of the EEP type magnetic element shown in FIGS. 1(*a*) and 1(*b*).

FIGS. 3(*a*) and 3(*b*) show other examples of the EEP type magnetic element shown in FIGS. 1(*a*) and 1(*b*). In a magnetic element 1*a* shown in FIG. 3(*a*), the back surface 5*c* in FIGS. 1(*a*) and 1(*b*) is formed linearly, namely an outer peripheral core 5 is formed in a rectangular shape in a plane view. In a magnetic element 1*b* shown in FIG. 3(*b*), the back surface 5*c* is formed in a polygonal shape in a plane view. In the present invention, the positioning of the core 2 is not necessary, and therefore a shape of the outer peripheral core 5 may be formed in any manner in accordance with a configuration, an arranging method or the like of the magnetic element. For example, by increasing a surface area of an outer peripheral surface of the outer peripheral core 5 other than the opening, heat dissipation performance can be improved and a temperature of the magnetic element can be decreased.

Figure 4:
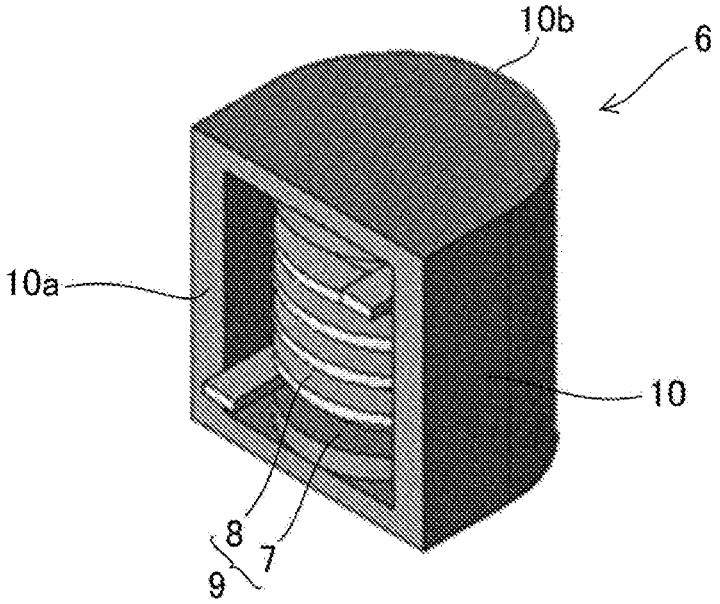
FIG. 4 is a perspective view illustrating other EEP type magnetic element.
Figure 5:
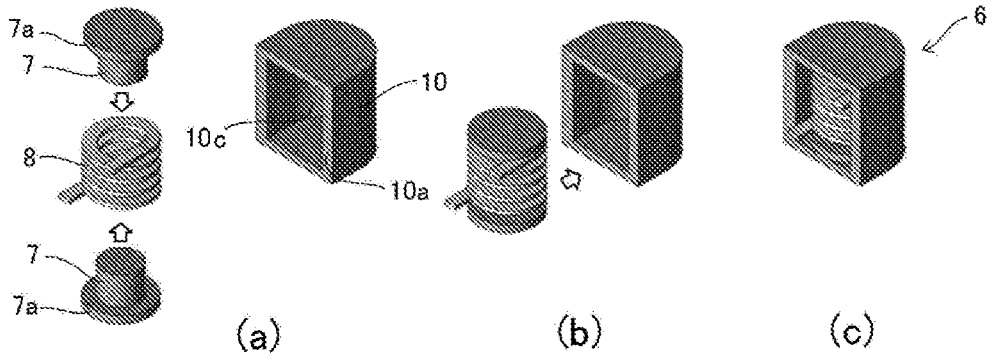
FIGS. 5(*a*) to 5(*c*) are views illustrating an assembling flow of the EEP type magnetic element shown in FIG. 4.

FIG. 4 and FIGS. 5(*a*) to 5(*c*) show other example of the EEP type magnetic element. FIG. 4 is a perspective view of the EEP type magnetic element, and FIGS. 5(*a*) to 5(*c*) are perspective views of an assembling flow. A magnetic element 6 is provided with a coil assembly 9 including a core 7 having a cylindrical shape and having a pair of flanges 7*a* at both ends in an axial direction and a coil 8 having a magnet wire wound on an outer periphery of the core 7, and an outer peripheral core 10 that surrounds an outer periphery of the coil assembly 9. Aback surface 10*b* of the outer peripheral core 10 opposite to an opening 10*a* is formed in a half circular shape in a plane view.

A magnetic member that forms the magnetic element 6 is formed by the cores 7 divided into a drum type core, and the outer peripheral core 10. The outer peripheral core 10 is formed such that the groove shown in FIGS. 1(*a*) and 1(*b*) is not formed, and an outer peripheral shape of the flange 7*a* is formed to adhere to an inner peripheral surface 10*c* of the outer peripheral core. When an outer periphery of the flange 7*a* adheres to the inner peripheral surface 10*c*, the coil assembly 9 is fixed in the outer peripheral core 10. Further, similar to the magnetic element 1 shown in FIGS. 1(*a*) and 1(*b*), a groove into which an outermost diameter portion of a drum type core is inserted may be formed in the outer peripheral core 10.

The drum type cores 7 divided into two parts in an axial direction of the coil 8 in which the magnet wire is wound in advance are inserted into the coil 8 along a direction of arrows (FIG. 5(*a*)). Further, the coil 8 may be formed by winding a magnet wire directly on the drum type core 7, and in this case, the drum type core 7 may not be divided into two parts. The drum type core 7 is inserted into the outer peripheral core 10 along a direction of an arrow such that the drum type core 7 adheres to the inner peripheral surface 10*c* formed on an inner peripheral surface of the outer peripheral core 10 (FIG. 5(*b*)). That is, the coil assembly is fixed in the outer peripheral core 10 when an outer periphery of the flange 7*a* adheres to the inner peripheral surface 10*c* of the outer peripheral core 10 (FIG. 5(*c*)).

In a case in which the resin sealing type magnetic element is formed, the shapes shown in FIGS. 1(*a*) and 1(*b*), FIGS. 3(*a*) and 3(*b*), FIG. 4, and FIGS. 5(*a*) to 5(*c*) described above, and FIGS. 8(*a*) to 8(*c*), and FIGS. 10(*a*) and 10(*b*) described below are preferable. The sealing resin can be arranged in advance prior to a coil insertion step in assembling. Further, it is preferable that a surface area of an outer diameter surface of the outer peripheral core other than the insertion opening for the coil is made large to such an extent that the magnetic performance thereof is not deteriorated. By forming the surface area to be large, a temperature increase of the magnetic element can be suppressed.

Figure 6:
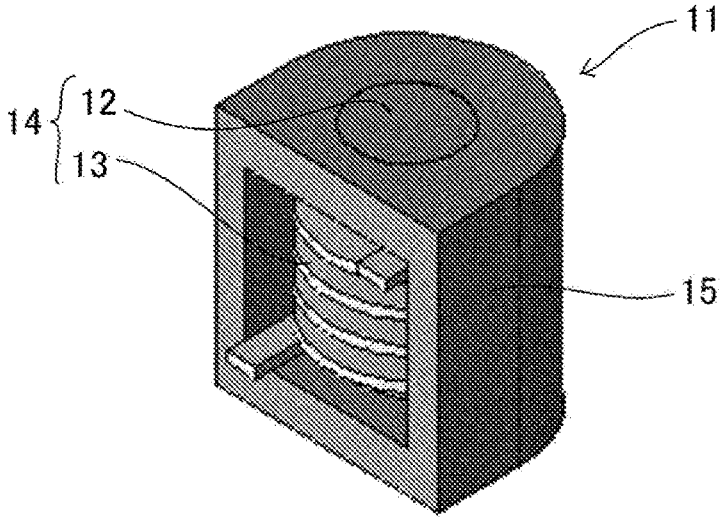
FIG. 6 is a perspective view illustrating other EEP type magnetic element.
Figure 7:
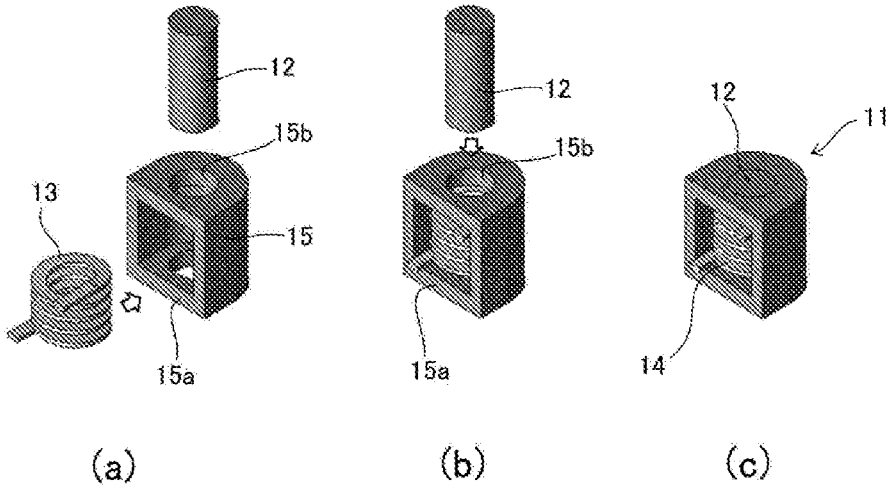
FIGS. 7(*a*) to 7(*c*) are views illustrating an assembling flow of the EEP type magnetic element shown in FIG. 6.

FIG. 6 and FIGS. 7(*a*) to 7(*c*) show other example of the EEP type magnetic element. FIG. 6 is a perspective view of the EEP type magnetic element, and FIGS. 7(*a*) to 7(*c*) are perspective views of an assembling flow. A magnetic element 11 is provided with a coil assembly 14 including a core 12 having a cylindrical shape and a coil 13 having a magnet wire wound on an outer periphery of the core 12, and an outer peripheral core 15 that surrounds substantially an outer periphery of the coil assembly 14. The outer peripheral core 15 has a through hole 15*b* into which the core 12 can be inserted. Two through holes 15*b* may be formed in an insertion direction of the core 12, or alternatively the through hole 15*b* may be formed at one side and non-through hole may be formed at another side. The non-through hole, which does not penetrate a portion at another side, can be used to prevent the core 12 from dropping off from another side in an axial direction.

The coil 13 wound in advance is inserted into an opening 15*a* of the outer peripheral core 15 along a direction of an arrow (FIG. 7 (*a*)), and the core 12 is inserted into the through hole 15*b* formed at an end surface of the outer peripheral core 15 along a direction of an arrow (FIG. 7 (*b*)). The coil assembly 14 formed by the coil 13 and the core 12 is fixed in the outer peripheral core 15 (FIG. 7 (*c*)). Further, the core 12 having excellent heat conductivity is exposed to a surface of the outer peripheral core 15, and therefore heat dissipation performance of the magnetic element 11 is improved.

Figure 18:
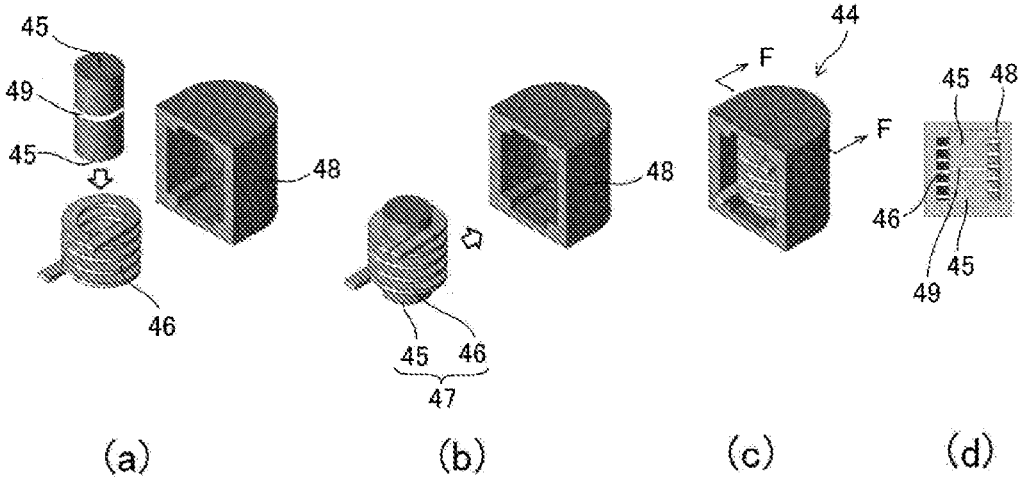
FIGS. 18(*a*) to 18(*d*) are views illustrating an EEP type magnetic element having a spacer.

FIGS. 18(*a*) to 18(*d*) show other example of the EEP type magnetic element. In the EEP type magnetic element, a gap for adjusting the magnetic properties of an inductor may be formed. FIGS. 18(*a*) to 18(*d*) show an example of the magnetic element in which a gap is formed by arranging a space between cores. FIGS. 18(*a*) and 18(*b*) are perspective views of an assembling method, FIG. 18 (*c*) is a perspective view of a completed product, and FIG. 18 (*d*) is a cross-sectional view taken along line F-F. A magnetic element 44 is provided with a coil assembly 47 including a core 45 having a cylindrical shape and a coil 46 arranged at an outer periphery of the core 45, and an outer peripheral core 48 that surrounds an outer periphery of the coil assembly 47. A spacer 49 is arranged between the cores 45 having a cylindrical shape. The magnetic element 44 is assembled by inserting the coil assembly 47 into the outer peripheral core 48.

Figure 8:
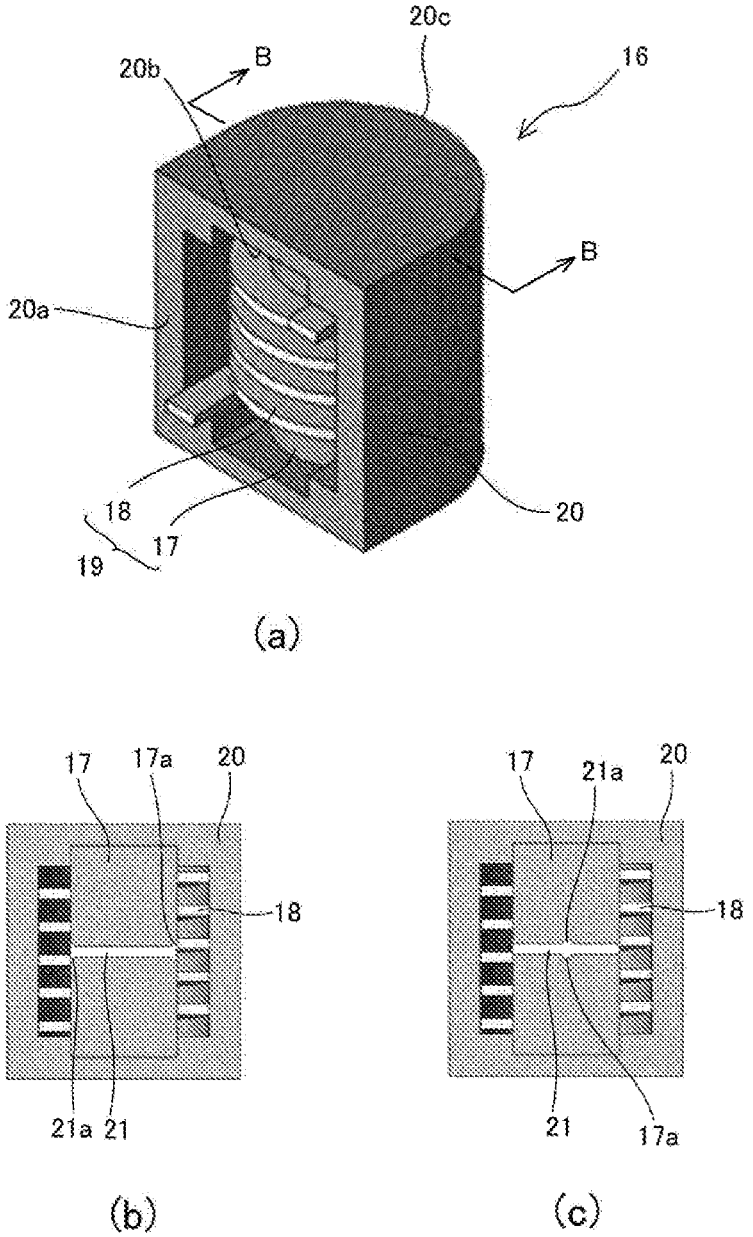
FIGS. 8(*a*) to 8(*c*) are a perspective view and cross-sectional views illustrating an EEP type magnetic element having a spacer.

FIGS. 8(*a*) to 8(*c*) show one example of a magnetic element having a spacer of the present invention. FIG. 8(*a*) is a perspective view of the EEP type magnetic element, and FIGS. 8(*b*) and 8(*c*) are cross-sectional views taken along line B-B. A magnetic element 16 is provided with a coil assembly 19 including a core 17 having a cylindrical shape and a coil 18 arranged at an outer periphery of the core 17, and an outer peripheral core 20 that surrounds an outer periphery of the coil assembly 19. A groove 20*b* is arranged on the outer peripheral core 20 at a side of an opening 20*a*, and a back surface 20*c* of the outer peripheral core 20 at an opposite side is formed in a half circular shape in a plane view. The core 17 having a cylindrical shape is inserted in an orthogonal direction against an axis of the magnetic element 16. The core 17 and the outer peripheral core 20 are magnetically integrated. Further, the core 17 having a cylindrical shape has a spacer 21 at an intermediate portion thereof, and the spacer 21 has the core 17 and a fitting portion 21*a*. As shown in FIG. 8(*b*), the fitting portion 21*a* may be formed in a circumferential portion of the core 17, or alternatively as shown in FIG. 8(*c*), the fitting portion 21*a* may be formed in a center portion in an axial direction of the core 17. A fitting portion 17*a* of the core 17 is formed at a portion to be fitted with the fitting portion 21*a* of the spacer 21. One of the fitting portion 21*a* and the fitting portion 17*a* is formed as a projection and another one is formed as a recess, and therefore the fitting portion 21*a* and the fitting portion 17*a* can be integrated by fitting with each other without using an adhesive or the like.

Figure 9:
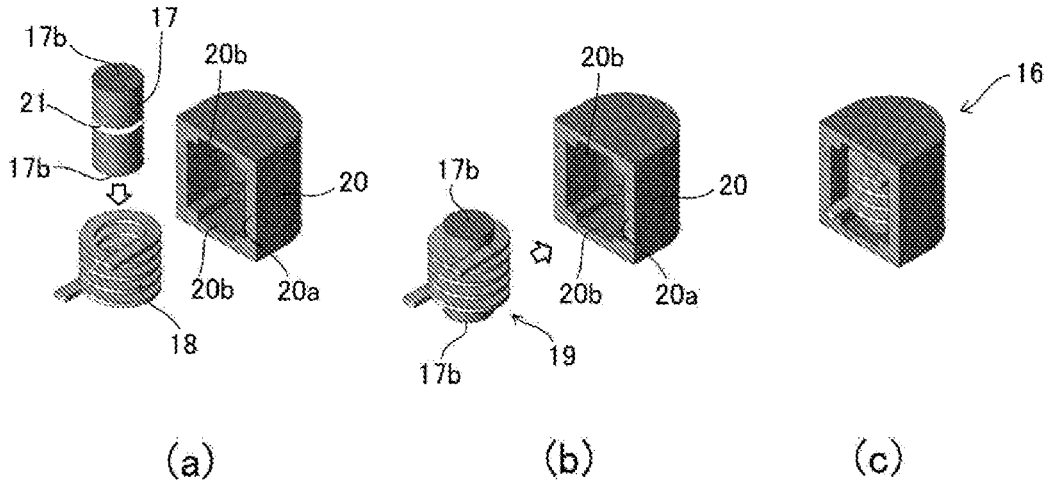
FIGS. 9(*a*) to 9(*c*) are views illustrating an assembling flow of the EEP type magnetic element shown in FIGS. 8(*a*) to 8(*c*).

FIGS. 9(*a*) to 9(*c*) show an assembling method of the magnetic element 16. FIGS. 9(*a*) to 9(*c*) are perspective views of the assembling method. A magnetic member that forms the magnetic element 16 is formed by two components divided into the core 17 having the spacer 21 and the outer peripheral core 20. The outer peripheral core 20 has the opening 20*a* into which the coil assembly 19 can be inserted, and the groove 20*b* for fixing the coil assembly 19 in the outer peripheral core 20, at an upper side and a lower side of the opening. The core 17 having a cylindrical shape is inserted into the coil 18 wound in advance, along a direction of an arrow (FIG. 9(*a*)). The core 17 having a cylindrical shape is inserted along the direction of an arrow such that both end portions 17*b* of the core 17 are along the upper and lower grooves 20*b* formed on an inner peripheral surface of the outer peripheral core 20. The groove 20*b* positions the core 17 having a cylindrical shape in an axial direction and in a radial direction excluding one direction of insertion (FIG. 9(*b*)). That is, the assembly 19 is fixed in the outer peripheral core 20 when inserted into the outer peripheral core 20 along the grooves 20*b* (FIG. 9 (*c*)). In this way, in the present invention, since the core 17 having a cylindrical shape is inserted in the orthogonal direction against the axial direction of the coil and the core 17 has the spacer fitted in advance, it is not necessary to perform positioning with respect to the radial direction other than the insertion direction, and the axial direction, and therefore the assembling is facilitated, and magnetic properties can be adjusted easily. Further, since the outer peripheral core 20 and the core 17 having a cylindrical shape are combined, the number of components can be reduced. Further, the core 17 may be formed in a polygonal columnar shape other than a cylindrical shape as long as the core 17 is formed in a columnar shape.

Figure 10:
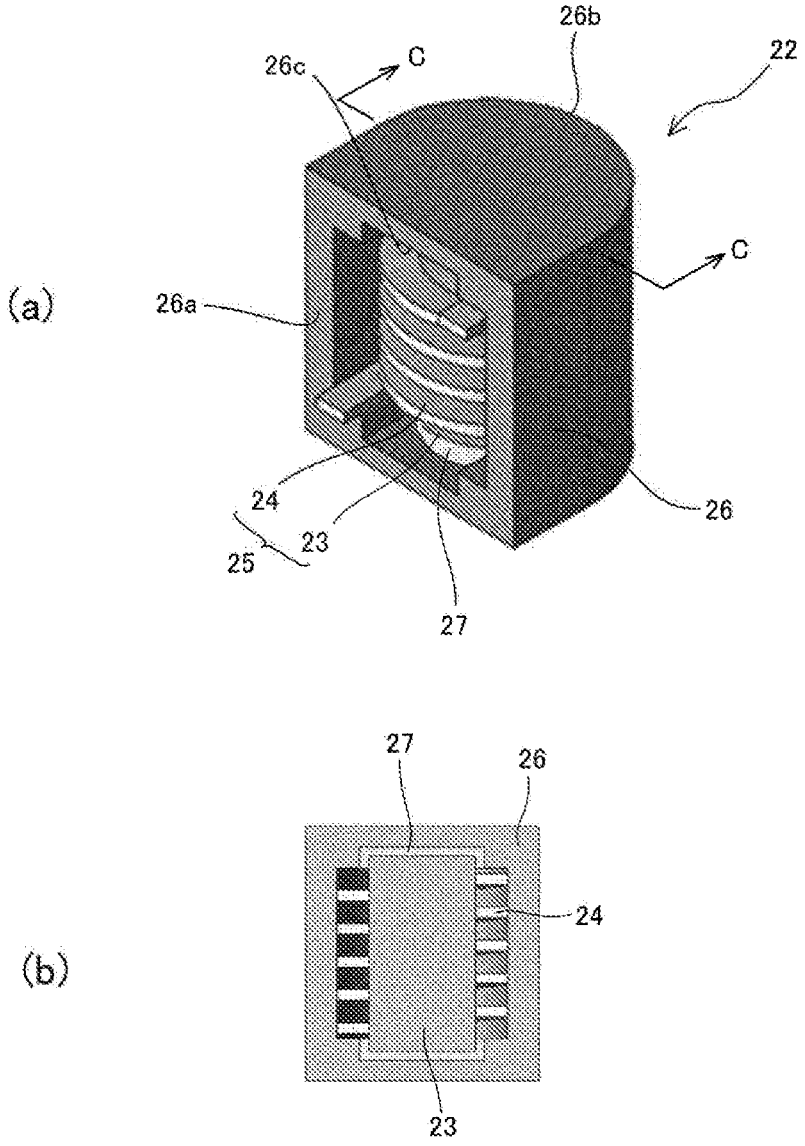
FIGS. 10(*a*) and 10(*b*) are a perspective view and a cross-sectional view illustrating other EEP type magnetic element having a spacer.
Figure 11:
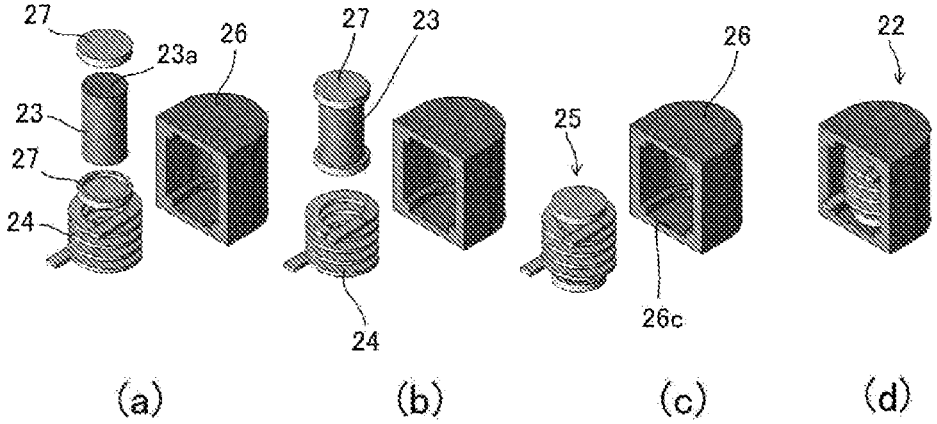
FIGS. 11(*a*) to 11(*d*) are views illustrating an assembling flow of the EEP type magnetic element shown in FIGS. 10(*a*) and 10(*b*).

FIGS. 10 (*a*) and 10 (*b*) and FIGS. 11 (*a*) to 11 (*d*) show other example of the EEP type magnetic element having the spacer. FIG. 10(*a*) is a perspective view of the EEP type magnetic element, FIG. 10 (*b*) is a cross-sectional view taken along line C-C, and FIGS. 11 (*a*) to 11 (*d*) are perspective views of an assembling flow. A magnetic element 22 is provided with a coil assembly 25 including a core 23 having a cylindrical shape and having a pair of spacers 27, each of which has a flange like shape at each end in an axial direction of the core 23, and a coil 24 having a magnet wire wound on an outer periphery of the core 23, and an outer peripheral core 26 that surrounds an outer periphery of the coil assembly 25. A back surface 26*b* of the outer peripheral core 26 opposite to an opening 26*a* is formed in a half circular shape in a plane view. Two spacers 27 are arranged at both end surface portions in the axial direction of the core 23 having a cylindrical shape formed by a magnetic body. A diameter of the spacer 27 is larger than a diameter of the core 23, and the spacer 27 and the core 23 are coaxially arranged. The spacer 27 is formed in a flat plate cylindrical shape, and an end surface in the axial direction of the core 23 is fitted into a portion of the flat plate cylindrical shape.

The outer peripheral core 26 has a groove 26*c* on an inner peripheral surface thereof. When the spacer 27 is inserted such that the outer periphery of the spacer 27 is along the groove 26*c* and the outer periphery of the spacer 27 adheres to the groove 26*c*, the coil assembly 25 is fixed in the outer peripheral core 26.

The spacers 27 are fitted with the both end surface portions 23*a* in the axial direction of the core 23 in advance, and the coil 24 is prepared. The coil 24 may be formed by winding a magnet wire on the core 23 directly, or alternatively the core 23 may be inserted into the coil 24 having the magnet wire wound in advance (FIGS. 11 (*a*) and 11 (*b*)). When the outer peripheral surface of the spacer 27 adheres to the inner peripheral surface 26*c* of the outer peripheral core 26, the coil assembly 25 is fixed in the outer peripheral core 26 (FIGS. 11 (*c*) and 11 (*d*)).

Figure 12:
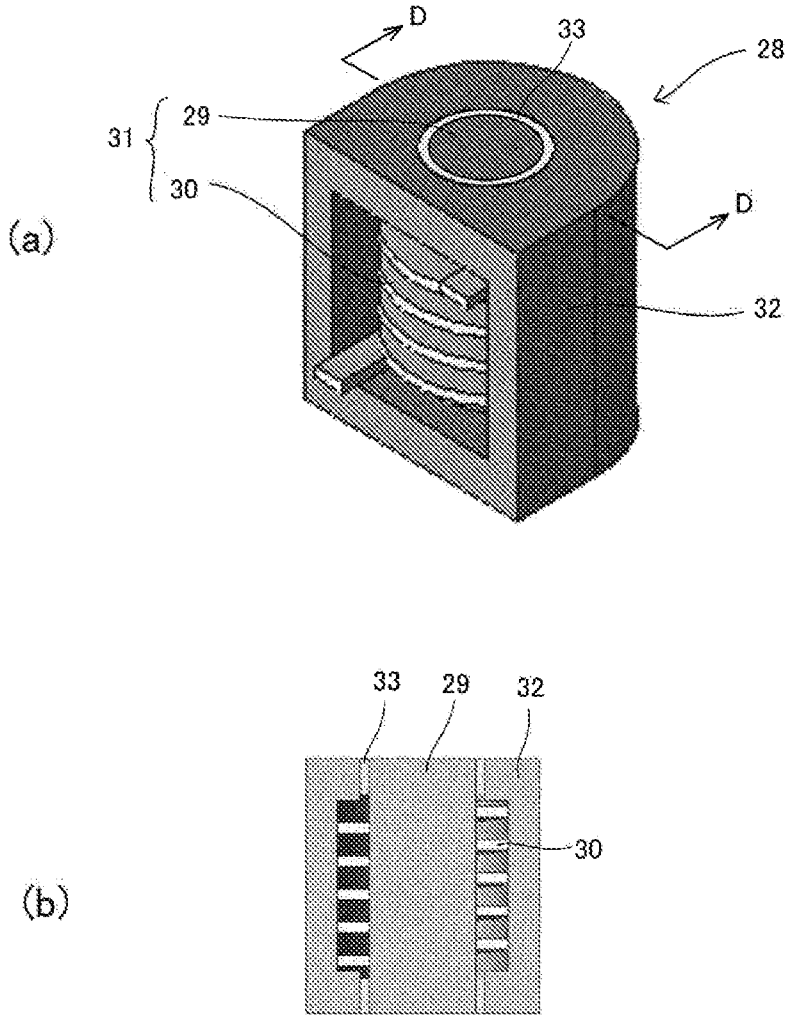
FIGS. 12(*a*) and 12(*b*) are a perspective view and a cross-sectional view illustrating other EEP type magnetic element having a spacer.
Figure 13:
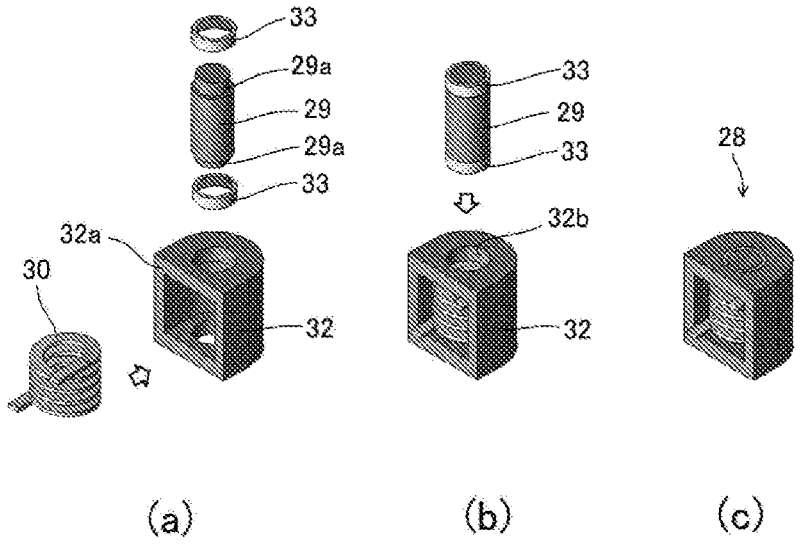
FIGS. 13 (*a*) to 13(*c*) are views illustrating an assembling flow of the EEP type magnetic element shown in FIGS. 12(*a*) and 12(*b*).

FIGS. 12 (*a*) and 12 (*b*) and FIGS. 13 (*a*) to 13 (*c*) show other example of the EEP type magnetic element having the spacer. FIG. 12(*a*) is a perspective view of the EEP type magnetic element, FIG. 12 (*b*) is a cross-sectional view taken along line D-D, and FIGS. 13(*a*) to 13(*c*) are perspective views of an assembling flow.

A magnetic element 28 is provided with a coil assembly 31 including a core 29 having a cylindrical shape and a coil 30 having a magnet wire wound on an outer periphery of the core 29, and an outer peripheral core 26 that surrounds substantially an outer periphery of the coil assembly 31. The outer peripheral core 32 has a through hole 32*b* into which the core 29 can be inserted.

A spacer 33 is fitted to a circumferential portion 29*a*, which is adjacent to an end surface in an axial direction, of the core 29 having a cylindrical shape. The spacer 33 is formed in a cylindrical shape to be fitted with the circumferential portion 29*a* formed as an axially small diameter portion arranged adjacent to the end surface in the axial direction of the core 29.

The coil 30 wound in advance is inserted into an opening 32*a* of the outer peripheral core 32 along a direction of an arrow (FIG. 13(*a*)), and the core 29 having the spacer is inserted into the through hole 32*b* formed at an end surface of the outer peripheral core 32 along a direction of an arrow (FIG. 13(*b*)). The coil assembly 31 formed by the coil 30 and the core 29 is fixed in the outer peripheral core 32 (FIG. 13 (*c*)). Further, an end surface of the core 29 having excellent heat conductivity is exposed to a surface of the outer peripheral core 32, and therefore heat dissipation performance of the magnetic element 28 is improved.

Figure 14:
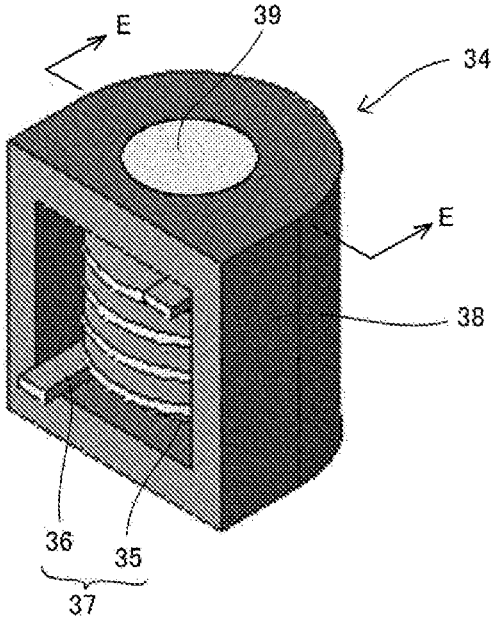
FIGS. 14(*a*) and 14(*b*) are a perspective view and a cross-sectional view illustrating other EEP type magnetic element having a spacer.
Figure 14:
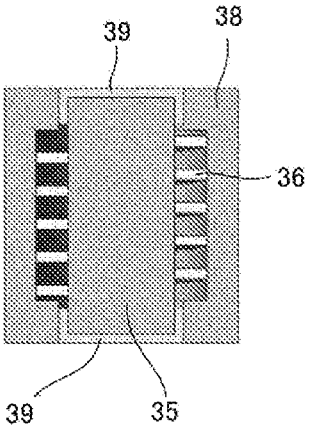
Figure 15:
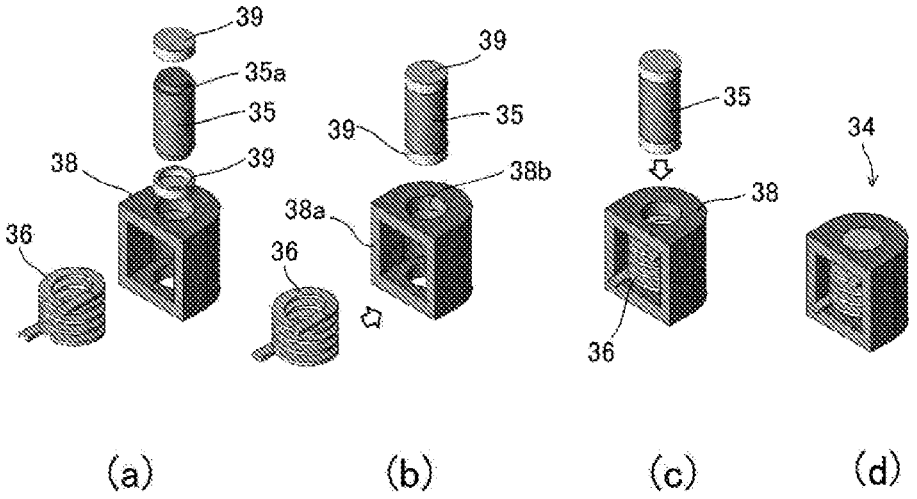
FIGS. 15 (*a*) to 15(*d*) are views illustrating an assembling flow of the EEP type magnetic element shown in FIGS. 14(*a*) and 14(*b*).

FIGS. 14 (*a*) and 14 (*b*) and FIGS. 15 (*a*) to 15 (*d*) show other example of the EEP type magnetic element having the spacer. FIG. 14 (*a*) is a perspective view of the EEP type magnetic element, FIG. 14 (*b*) is a cross-sectional view taken along line E-E, and FIGS. 15(*a*) to 15(*d*) are perspective views of an assembling flow.

A magnetic element 34 is provided with a coil assembly 37 including a core 35 having a cylindrical shape and a coil 36 having a magnet wire wound on an outer periphery of the core 35, and an outer peripheral core 38 that surrounds an outer periphery of the coil assembly 37. The outer peripheral core 38 has a through hole 38*b* into which the core 35 can be inserted.

Spacers 39 are arranged on circumferential portions adjacent to both end surfaces in an axial direction and the end surfaces of the core 35 having a cylindrical shape. A diameter of the spacer 39 is the same as a diameter of the core 35, and the spacer 39 and the core 35 are coaxially arranged. The spacer 39 is formed in a flat plate cylindrical shape, and a projection 35*a* at an end surface in the axial direction of the core 35 is fitted into a portion of the flat plate cylindrical shape.

The spacers 39 are fitted to the both end surfaces of the core 35, and coil 36 wound in advance is inserted into an opening 38*a* of the outer peripheral core 38 along a direction of an arrow, and the core 35 is inserted into a through hole 38*b* formed on an end surface of the outer peripheral core 38 along a direction of an arrow (FIGS. 15 (*a*) to 15 (*c*)). The coil assembly 37 formed by the coil 36 and the core 35 is fixed in the outer peripheral core 38 (FIG. 15 (*d*)).

In the present invention, it is preferable that each of the core and the outer peripheral core is formed by a molded magnetic body such as a compression molded magnetic body and an injection molded magnetic body, and more preferably, the core described above is formed by the compression molded magnetic body and the outer peripheral core is formed by the injection molded magnetic body.

In the present invention, the compression molded magnetic body that can be used as the core is formed of magnetic materials such as pure iron-based soft magnetic material such as iron powder and iron nitride powder; iron group alloy-based soft magnetic material such as Fe—Si—Al alloy (Sendust) powder, Super Sendust powder; Ni—Fe alloy (permalloy) powder, Co—Fe alloy powder and Fe—Si—B-based alloy powder; ferrite-based magnetic material; amorphous-based magnetic material; and microcrystalline material.

Examples of the ferrite-based magnetic material include spinel ferrite having a spinel crystalline structure such as manganese zinc ferrite, nickel zinc ferrite, copper zinc ferrite, and magnetite; hexagonal ferrite such as barium ferrite and strontium ferrite; and garnet ferrite such as yttrium iron garnet. Of these ferrite-based magnetic materials, the spinel ferrite which is a soft magnetic ferrite is preferable because it has a high magnetic permeability and a small eddy current loss in a high frequency domain. Further, examples of the amorphous-based magnetic material include iron-based alloys, cobalt-based alloys, nickel-based alloys, and mixtures of these amorphous alloys.

Examples of oxides forming an insulation film on the surfaces of particles of soft magnetic metal powder to be used as the raw materials described above for the compression molded magnetic body include oxides of insulation metals or semimetals such as $Al_2O_3$, $Y_2O_3$, MgO, and $ZrO_2$; glass; and mixtures of these substances. As methods of forming the insulation film, it is possible to use a powder coating method such as mechanofusion, a wet thin film forming method such as electroless plating and a sol-gel method, and a dry thin film forming method such as sputtering.

The compression molded magnetic body can be manufactured by pressure-molding the material powder described above having the insulation film formed on the surfaces of particles thereof or pressure-molding powder composed of the material powder described above and thermosetting resin such as epoxy resin added thereto to obtain a compressed powder compact and thereafter by firing the compressed powder compact. As the total of the amount of the material powder and that of the thermosetting resin is 100 percentages by mass, it is preferable to set the mixing ratio of the material powder in a range between 96 and 100 percentages by mass. When the mixing ratio of the material powder is less than 96 percentages by mass, the mixing ratio thereof is low. Thus, the material powder has a low magnetic flux density and a low magnetic permeability.

The average diameter of the particles of the material powder is preferably set in a range between 1 and 150 μm and more preferably set in a range between 5 and 100 μm. In a case in which the average diameter of the particles of the material powder is less than 1 μm, the compressibility (a measure showing the hardenability of powder) of the material powder is low in a pressure-molding operation. Consequently the strength of the material for the compression molded magnetic body becomes outstandingly low after the compressed powder compact is fired. In a case in which the average diameter of the particles of the material powder is more than 150 μm, the material powder has a large iron loss in a high frequency domain. Consequently the material powder has a low magnetic characteristic (frequency characteristic).

As a compression molding method, it is possible to use a method of filling the material powder into a molding die and press-molding the material powder at a predetermined pressure to obtain the compressed powder compact. A fired object is obtained by firing the compressed powder compact. In a case in which amorphous alloy powder is used as the material for the compression molded magnetic body, it is necessary to set a firing temperature lower than the crystallization start temperature of the amorphous alloy. In a case in which the powder to which the thermosetting resin has been added is used, it is necessary to set the firing temperature to a temperature range in which the resin hardens.

In the present invention, the injection molded magnetic body that can be used as the outer peripheral core is obtained by adding a binding resin to the raw material powder for the compression molded magnetic body described above and by injection-molding the mixture of the binding resin and the raw material powder. It is preferable to adopt the amorphous metal powder as the magnetic powder because the amorphous metal powder allows the injection molding to be easily performed, the configuration of the injection molded magnetic body formed by the injection molding to be easily maintained, and the composite magnetic core to have an excellent magnetic characteristic. As the amorphous metal powder, it is possible to use the iron-based alloys, cobalt-based alloys, nickel-based alloys, and mixtures of these amorphous alloys described above. The insulation film described above is formed on the surfaces of these amorphous metal powders.

As the binding resin, it is possible to use a thermoplastic resin that can be injection-molded. Examples of the thermoplastic resin include polyolefin such as polyethylene and polypropylene, polyvinyl alcohol, polyethylene oxide, polyphenylene sulfide (PPS), liquid crystal polymer, polyether ether ketone (PEEK), polyimide, polyetherimide, polyacetal, polyether sulfone, polysulfone, polycarbonate, polyethylene terephthalate, polybutylene terephthalate, polyphenylene oxide, polyphthalamide, polyamide, and mixtures of these thermoplastic resins. Of these thermoplastic resins, the polyphenylene sulfide (PPS) is more preferable than the other thermoplastic resins because the polyphenylene sulfide (PPS) is excellent in its flowability in an injection molding operation when it is mixed with the amorphous metal powder, is capable of coating the surface of the resulting injection-molded body with a layer thereof, and is excellent in its heat resistance.

As the total of the amount of the material powder and that of the thermoplastic resin is 100 percentages by mass, it is preferable to set the mixing ratio of the material powder in a range between 80 and 95 percentages by mass. In a case in which the mixing ratio of the material powder is less than 80 percentages by mass, the material powder is incapable of obtaining the predetermined magnetic characteristic. In a case in which the mixing ratio of the material powder exceeds 95 percentages by mass, the material powder causes the injection molding performance to be inferior.

As the injection molding method, it is possible to use a method of injecting the raw material powder into a molding die consisting of a movable half thereof butted with a fixed half thereof. As the injection molding condition, it is preferable to set the temperature of the resin in a range between 290 and 350° C. and that of the molding die in a range between 100 and 150° C. in the case of the polyphenylene sulfide (PPS), although the injection molding condition is different according to the kind of the thermoplastic resin.

The compression molded magnetic body to be the core and the injection molded magnetic body to be the outer peripheral core in the preferred embodiment are manufactured by the methods described above, respectively. Further, in a case in which the compression molded magnetic body and the injection molded magnetic body are adhered, it is preferable to adopt a solventless epoxy based adhesive to allow both of them to adhere to each other.

A preferable combination of the material for the compression molded magnetic body and the material for the injection molded magnetic body is a combination of amorphous or pure iron powder for the compression molded magnetic body and amorphous metal powder and the thermoplastic resin for the injection molded magnetic body. More preferably, Fe—Si—Cr-based amorphous alloy is used as the amorphous metal and the polyphenylene sulfide (PPS) is used as the thermoplastic resin.

A thermosetting resin is preferable as the sealing resin in a case of performing the resin sealing, and examples of the thermosetting resin include an epoxy resin, a phenol resin, and an acryl resin having excellent heat resistance and excellent corrosion resistance. As the epoxy resin, one-pack or two-pack type epoxy resin containing similar resin components to the resin binder described above can be used. Further, as a curing agent of the epoxy resin, an amine-based curing agent, a polyamide-based curing agent, or an acid anhydride-based curing agent can be used as needed other than the latent epoxy curing agent described above. It is preferable to set a curing temperature range and a curing time to be similar to those of the resin binder described above. In the phenol resin, for example, a novolak type phenol resin or a resol type phenol resin can be used as the resin component thereof, and as a curing agent of the phenol resin, hexamethylenetetramine can be used.

The spacer that can be used in the present invention may be formed of a non-magnetic body. Examples of the non-magnetic body include the thermoplastic resin described as the binding resin described above, the thermosetting resin described as the sealing resin, ceramics, non-magnetic metal, and a foam body of these materials. The spacer can be formed in a cylindrical shape or a flat plate cylindrical shape by means of injection molding or the like.

In the magnetic element of the present invention, for example, the coil assembly is formed by arranging the coil in which the magnet wire is wound around the compression molded magnetic body described above so as to have an inductor function. The magnetic element is installed into an electrical device circuit, or an electronic device circuit. As the magnet wire, an enamel wire can be used. As a kind of the magnet wire, a urethane wire (UEW), a formal wire (PVF), a polyester wire (PEW), a polyester imide wire (EIW), a polyamideimide wire (AIW), a polyimide wire (PIW), a double coated wire consisting of these wires combined with one another, a self-welding wire, and a litz wire may be adopted. The polyamideimide wire (AIW) and the polyimide wire (PIW) are preferable because these wires are excellent in the heat resistance. A round wire or a rectangular wire in a section may be adopted as the magnet wire. Especially, by winding a minor diameter side of the rectangular wire in the section around the compression molded magnetic body with the rectangular wire in contact with the circumference thereof in an overlapped state, a coil assembly having an improved winding density can be obtained. As a conductor of the magnet wire, metal having excellent conductivity can be used. Examples of the conductor include copper, aluminum, gold and silver.

The magnetic element of the present invention can be used in a power source circuit of a vehicle including a motorcycle, an industrial device or a medical device, a filter circuit, a switching circuit or the like, and therefore the magnetic element can be used as, for example, an inductor, a transformer, an antenna, a choke coil, a filter, or the like. Further, the magnetic element can be used as a surface mounting member. Especially, a high efficiency DC/DC converter, a charging device, and an inverter, which are used for a solar power generator or used as an on-vehicle device, are required to be miniaturized or reduced in a height thereof, and therefore the inductor of the present invention can be preferably used.

Figure 16:
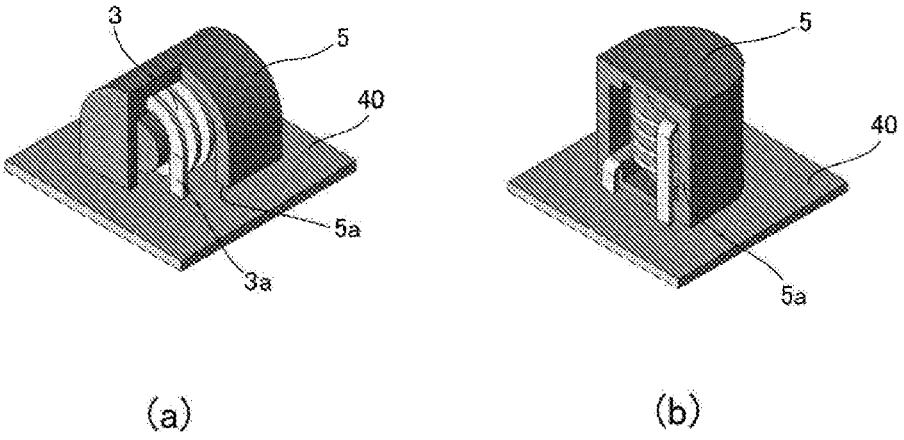
FIGS. 16(*a*) and 16(*b*) are views illustrating an example of the magnetic element used as a surface mounting member.

FIGS. 16(*a*) and 16(*b*) show examples in which the magnetic element of the present invention is used as a surface mounting member. FIG. 16(*a*) is a partially missing perspective view illustrating a preferred mounting example of the magnetic element, and FIG. 16(*b*) illustrates other mounting example of the magnetic element.

As shown in FIG. 16(*a*), by arranging the opening 5*a* of the outer peripheral core 5 to face a substrate 40 of an electronic member, a distance between a coil wound portion and the substrate 40 is reduced, and therefore an amount of the magnet wire can be suppressed. Further, a coil terminal 3*a* is drawn along a tangent direction of the coil 3 and the magnetic element can be mounted to a surface of the substrate 40 with a minimum bending processing, and thereby a processing cost can be reduced. Further, the bending processing is reduced compared to a magnetic element shown in FIG. 16(*b*), and therefore direct current resistance can be reduced and the processing cost can be reduced. Further, also in the magnetic element shown in FIG. 16(*b*), by forming the opening 5*a* of the outer peripheral core 5 to be an opened surface and by fixing at least one outer peripheral surface of the outer peripheral core 5 to adhere to the substrate 40, although the body of the magnetic element becomes large, the magnetic element having excellent heat dissipation performance can be obtained.

INDUSTRIAL APPLICABILITY

The magnetic element of the present invention is capable of reducing the number of components and producing man hour, and therefore excellent productivity is obtained. Consequently the magnetic element of the present invention can be preferably used in various electric devices and electronic devices.

REFERENCE SIGNS LIST

1, 6, 11, 16, 22, 28, 34, 44: magnetic element
2, 7, 12, 17, 23, 29, 35, 45: core
3, 8, 13, 18, 24, 30, 36, 46: coil
4, 9, 14, 19, 25, 31, 37, 47: coil assembly
5, 10, 15, 20, 26, 32, 38, 48: outer peripheral core
21, 27, 33, 39, 49: spacer
40: substrate
41: magnetic element of a conventional example
42: outer peripheral core of a conventional example
43: coil of a conventional example

The invention claimed is:

1. A magnetic element comprising:

a coil assembly including a core and a coil arranged at an outer periphery of the core; and an outer peripheral core configured to surround an outer periphery of the coil assembly, wherein the magnetic element is a resin sealing type magnetic element in which a gap between the coil and the outer peripheral core is filled with a resin, wherein the outer peripheral core comprises an opening into which the coil assembly is inserted, and a fixing unit configured to fix the coil assembly in the outer peripheral core, wherein the core is formed as a columnar core, wherein the fixing unit is formed by a pair of grooves arranged on an inner peripheral surface in the outer peripheral core and into which both end portions of said columnar core are inserted in an axial direction in contact with said grooves; and said grooves position the columnar core in an axial direction and in a radial direction excluding one direction of insertion, so that the coil assembly is fixed to the outer peripheral core, wherein the core is formed by a compression molded magnetic body, and the outer peripheral core is formed by an injection molded magnetic body, wherein the outer peripheral core is formed from a single member, and the magnetic element is an EEP type magnetic element.

2. The magnetic element according to claim 1, wherein:

a spacer configured to be fitted with the columnar core is arranged in at least one of an intermediate portion in an axial direction, or a circumferential portion adjacent to an end surface in the axial direction of the columnar core.

3. The magnetic element according to claim 1, wherein the outer peripheral core in which the coil assembly is fixed is formed such that at least one outer peripheral surface of the outer peripheral core is fixed to a substrate of an electronic device.

* * * * *